US010084272B1

(12) United States Patent
Hayes et al.

(10) Patent No.: US 10,084,272 B1
(45) Date of Patent: Sep. 25, 2018

(54) MODULAR ELECTRICAL RECEPTACLE

(71) Applicant: Group Dekko, Inc., Garrett, IN (US)

(72) Inventors: Daniel Hayes, Kendallville, IN (US); Shawn J. Kondas, Kendallville, IN (US)

(73) Assignee: Group Dekko, Inc., Garrett, IN (US)

( * ) Notice: Subject to any disclaimer, the term of this patent is extended or adjusted under 35 U.S.C. 154(b) by 56 days.

(21) Appl. No.: 15/467,169

(22) Filed: Mar. 23, 2017

(51) Int. Cl.

| | |
|---|---|
| ***H01R 13/60*** | (2006.01) |
| ***H01R 25/00*** | (2006.01) |
| ***H01R 24/64*** | (2011.01) |
| ***H01R 13/514*** | (2006.01) |
| ***H01R 13/66*** | (2006.01) |
| *H01R 107/00* | (2006.01) |

(52) U.S. Cl.
CPC ..... *H01R 25/003* (2013.01); *H01R 13/514* (2013.01); *H01R 13/6675* (2013.01); *H01R 24/64* (2013.01); *H01R 2107/00* (2013.01)

(58) Field of Classification Search
CPC ..... H01R 13/518; H01R 23/7073; H01R 13/514; H01R 9/2408; H01R 23/6873; H01R 23/025
USPC ..... 439/540.1, 541.5, 701, 717, 594, 439/607.23–607.26
See application file for complete search history.

(56) References Cited

U.S. PATENT DOCUMENTS

| | | | | |
|---|---|---|---|---|
| 2014/0098445 | A1* | 4/2014 | Hooper | H02H 3/16 361/42 |
| 2014/0183977 | A1* | 7/2014 | Braunstein | H02G 3/00 307/147 |
| 2015/0001937 | A1* | 1/2015 | Wang | H01R 13/70 307/52 |
| 2016/0111837 | A1* | 4/2016 | Misener | H01R 13/506 439/345 |

* cited by examiner

*Primary Examiner* — Phuong Chi T Nguyen
(74) *Attorney, Agent, or Firm* — Taylor IP, P.C.

(57) ABSTRACT

An electrical receptacle assembly including a first and second housing, a circuit and an electrical cable. The first housing has a plurality of electrical power output selections. The second housing has an electrical receptacle connector presented on a face thereof, the circuit is in the second housing being coupled to the connector. The electrical cable is coupled to the circuit and to the electrical power output selections, the circuit selecting one of the plurality of electrical power output selections to be supplied from the first housing to the connector.

13 Claims, 4 Drawing Sheets

MODULAR ELECTRICAL RECEPTACLE

BACKGROUND OF THE INVENTION

1. Field of the Invention

The present invention relates to electrical power receptacles, and, more particularly, to modular electrical receptacles that can be used to upgrade legacy systems.

2. Description of the Related Art

In many applications, electrical receptacles are needed to receive and distribute power. They are required in permanent locations such as walls in fixed structures, as well as temporary locations such as modular office furniture. Many types of receptacles are required according to the needs of users. Some receptacles, for example, include distribution of power for computers, telephones, and corded appliance, etc. The electrical receptacles also are required in places that are convenient for the user, and may need to be re-located.

Electrical signals and power can be conveyed by way of Universal Serial Bus (USB) Type-C cables, commonly known as simply USB-C. The connectors or receptacles on the USB-C cable are 24-pin fully reversible-plugs allowing for the transport of data and energy.

The USB-C connectors connect to both hosts and devices, replacing various USB-B and USB-A connectors and cables with a standard meant to be very adaptable and remain useful for future technological changes. The 24-pin double-sided connector is slightly larger than the micro-B connector, with a USB-C port measuring 8.4 millimeters (0.33 in) by 2.6 millimeters (0.10 in). The USB-C connectors make provision for four power/ground pairs, two differential pairs for non-SuperSpeed data, four pairs for SuperSpeed data bus, two "sideband use" pins, VCONN +5 V power for active cables, and a configuration pin used for cable orientation detection and a dedicated biphase mark code (BMC) configuration data channel.

Connecting an older device to a host with a USB-C receptacle requires a cable or adapter with a USB-A or USB-B plug or receptacle, as appropriate, on one end and a USB-C plug on the other end. Devices may be hosts or peripherals when using the USB-C protocol. Some, such as mobile phones, can take either role depending on what is detected on the other end of the cable. These types of applications are called Dual-Role-Data (DRD). When two such devices are connected, the roles are randomly assigned but a swap can be commanded from either end. Furthermore, DRD devices that support USB Power Delivery may independently and dynamically swap data and power roles using the Data Role Swap or Power Role Swap processes allowed by the USB-C protocol. This allows for charge-through hub or docking station applications where the Type-C device acts as a USB data host while acting as a power consumer rather than a source.

USB-C devices may optionally support bus power currents of 1.5 A and 3.0 A (at 5 V) or even 20 volts at up to 5 amps, in addition to baseline bus power provision; power sources can either advertise increased USB current through the configuration channel, or they can support the full USB Power Delivery specification.

USB-C version 3.1 cables are considered full-featured USB-C cables. They are electronically marked cables that contain a chip with an ID function based on the configuration channel and vendor-defined messages (VDM) from the USB Power Delivery 2.0 specification. USB-C version 2.0 cables do not have shielded SuperSpeed pairs, sideband use pins, or additional wires for power lines.

While there are variations in the capabilities of USB-C cables, all USB-C cables must support 3 A current, up to 60 W; cables supporting higher power at 5 A current (up to 100 W) must contain e-marker chips programmed to identify the cable as being 5 A capable. Full-featured USB-C version 3.1 cables can handle up to 10 Gigabit/s data rate at full duplex.

What is needed in the art is a module system that will allow receptacle housings to be easily updated with a selectable electrical power delivery.

SUMMARY OF THE INVENTION

The present invention is directed to an improved electrical receptacle arrangement allowing legacy receptacle housings to be updated to new configurations.

The present invention provides an electrical receptacle assembly including a first and second housing, a circuit and an electrical cable. The first housing has a plurality of electrical power output selections. The second housing has an electrical receptacle connector presented on a face thereof, the circuit is in the second housing being coupled to the connector. The electrical cable is coupled to the circuit and to the electrical power output selections, the circuit selecting one of the plurality of electrical power output selections to be supplied from the first housing to the connector.

The present invention further provides a modular electrical receptacle insertable into a receptacle housing. The modular electrical receptacle includes first and second housings, a circuit and an electrical cable. The first housing has a plurality of electrical power output selections couplable to the electrical cable. The second housing has an electrical connector presented on a face thereof, and a circuit that is electrically coupled to the connector. The electrical cable is coupled to the circuit and to the electrical power output selections, the circuit selecting one of the plurality of electrical power output selections to be supplied from the first housing to the electrical connector.

The present invention further provides a method of installing a modular connector into a receptacle housing, the method including the steps of providing a modular electrical connector that includes first and second housings. The first housing has a plurality of electrical power output selections. The second housing has an electrical connector presented on a face thereof, and a circuit electrically coupled to the connector. The electrical cable is coupled to the circuit and to the electrical power output selections, and the circuit selects one of the plurality of electrical power output selections to be supplied from the first housing to the electrical connector. The next step being inserting the second housing into the receptacle housing; and the next step is aligning the face of the second housing to an accommodating opening on a face of the receptacle housing.

An advantage of the present invention is that the power delivery module selects the electrical power to be sent to itself.

Another advantage of the present invention is that legacy receptacle systems can be updated to supply power to USB-C compatible devices.

Yet another advantage of the present invention is that a USB-C cable is captively secured to the assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
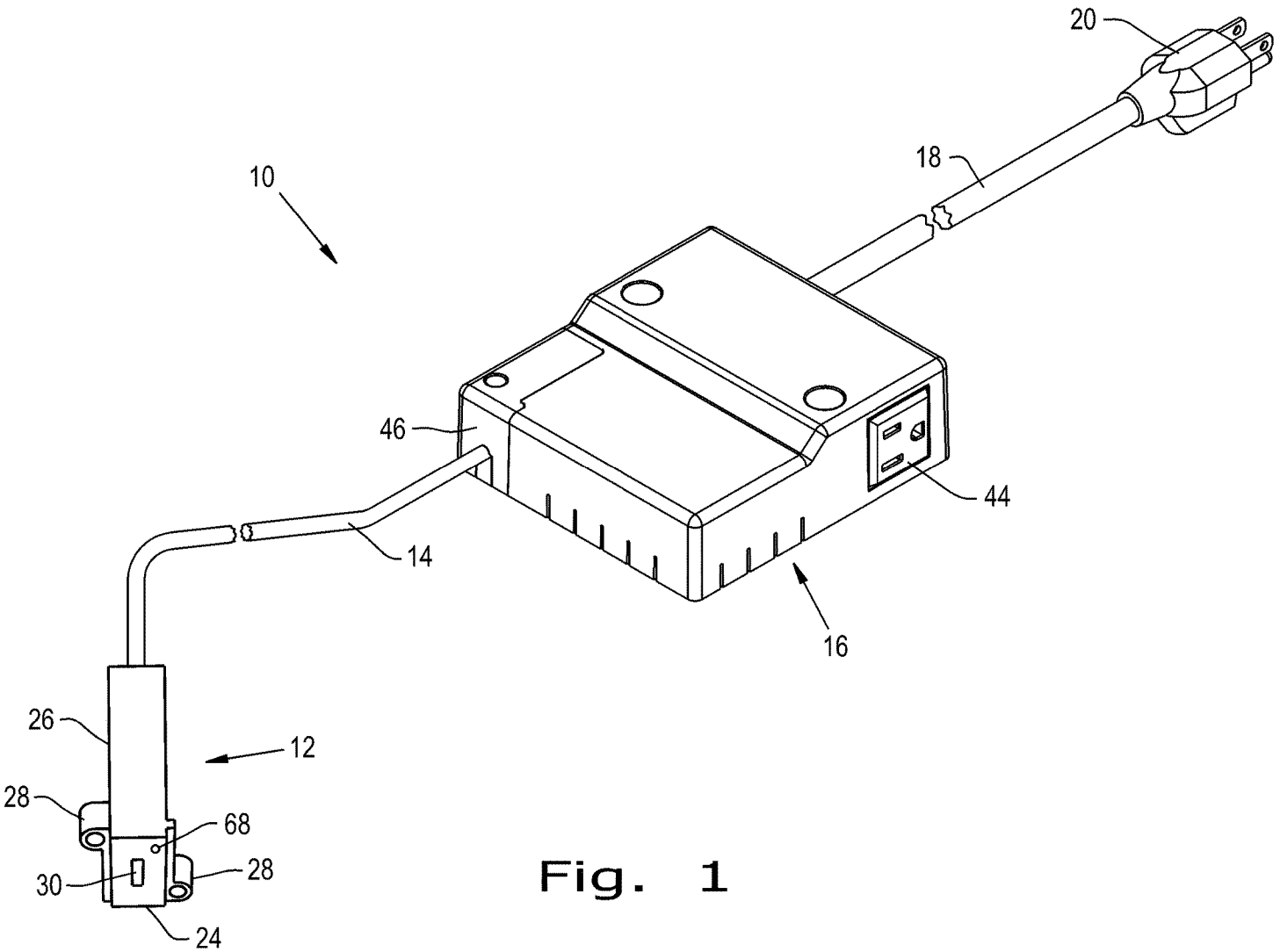
FIG. 1 is a perspective view of an embodiment of an electrical receptacle assembly of the present invention.

Referring now to FIG. 1, there is shown an embodiment of an electrical receptacle assembly 10 having an electrical housing assembly 12, an electrical cable 14, an electrical housing assembly 16, and a power cord 18 with a plug 20 coupled thereto. Power cord 18 conveys electrical power to housing 16, which in turn supplies a selected voltage and current to housing 12 by way of electrical cable 14.

Figure 2:
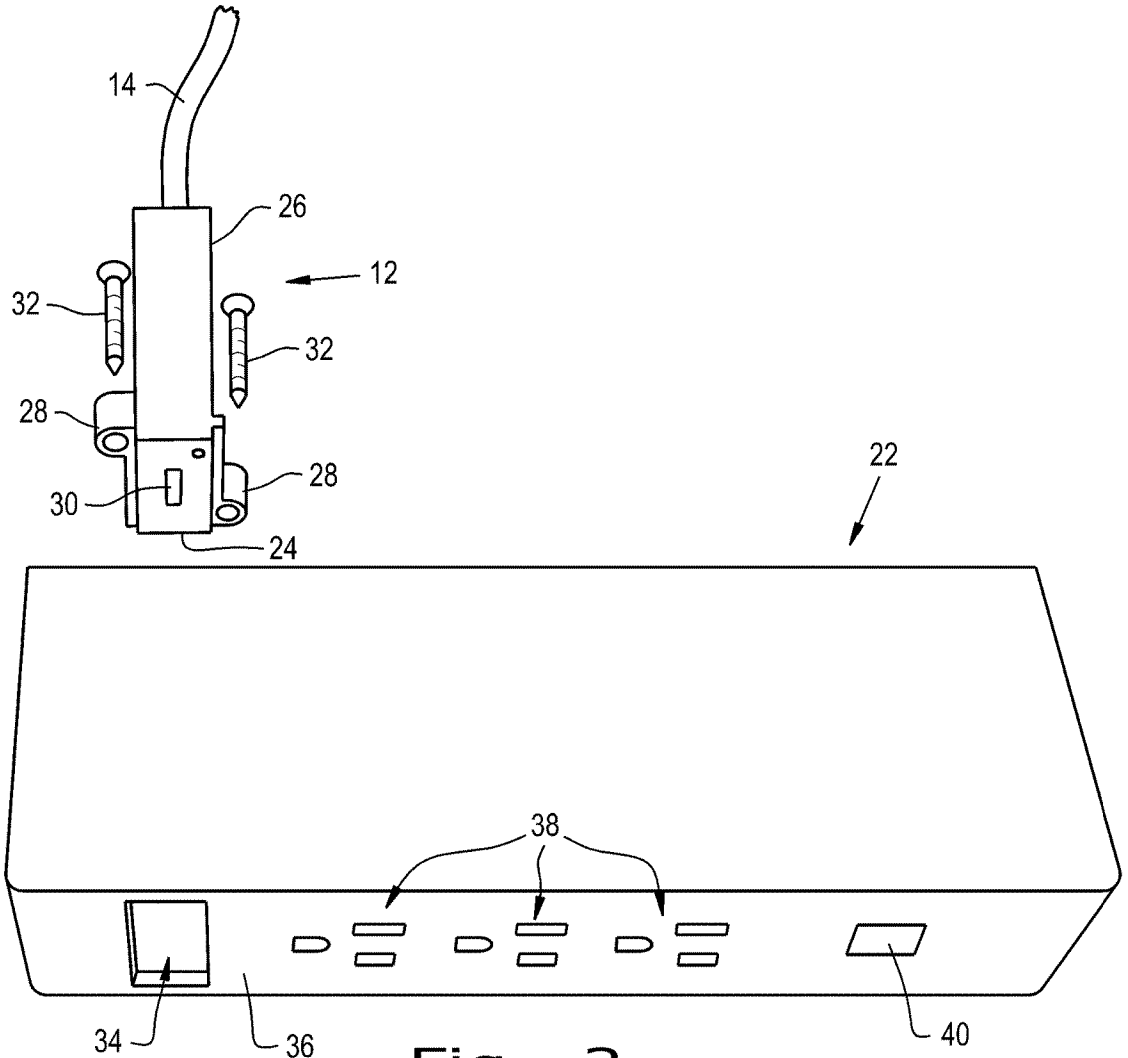
FIG. 2 is a front perspective view of a housing of the embodiment of FIG. 1 being inserted into another housing.
Figure 3:
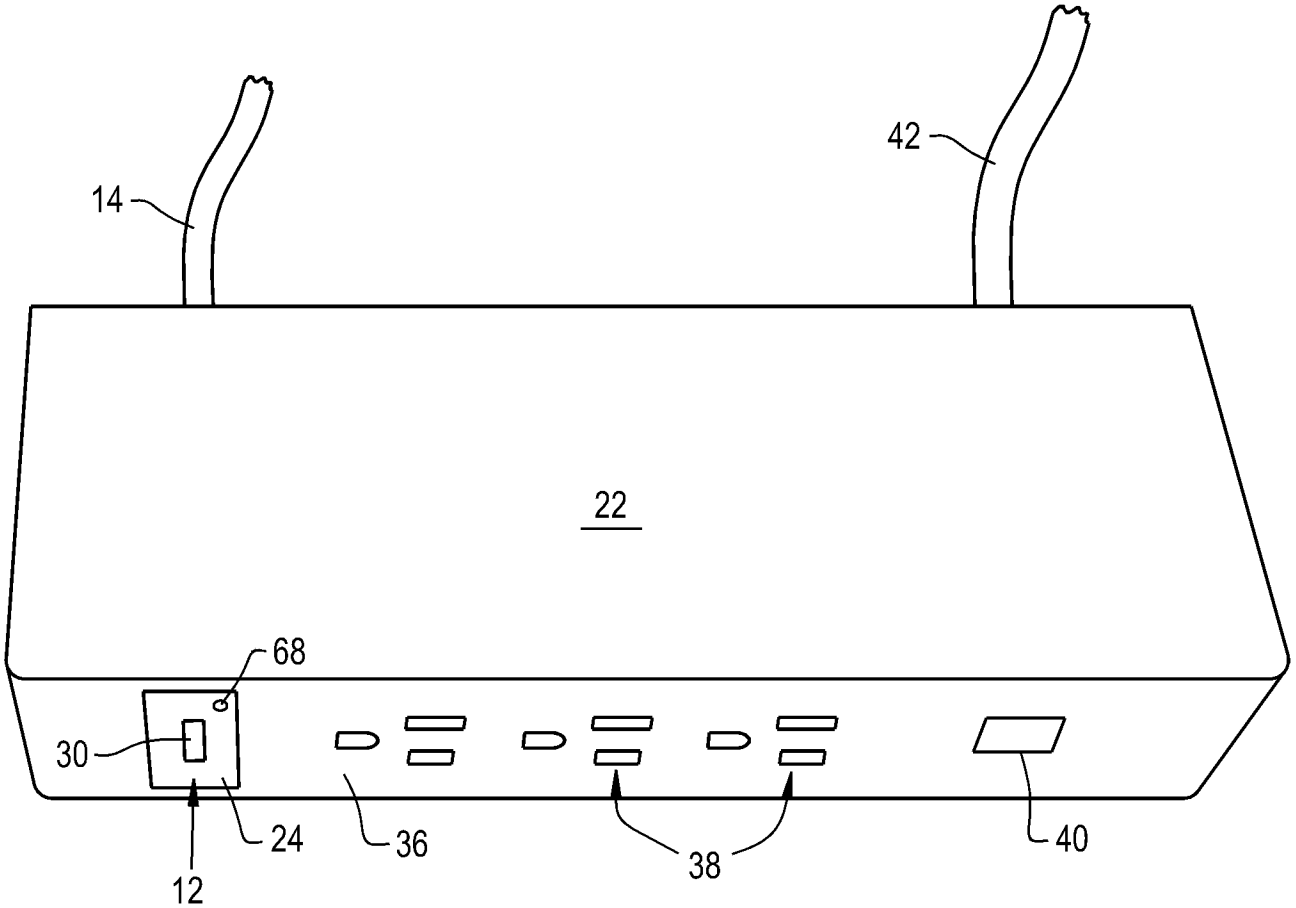
FIG. 3 is another front perspective view of the housing of FIG. 2 having the module of FIG. 1 inserted therein.

Now, additionally referring to FIGS. 2 and 3 there is additionally shown an electrical receptacle housing 22 into which housing 12 is insertable. Housing 12 includes a face 24, a body 26, mounting tabs 28 and a connector 30. Connector 30 is a Universal Serial Bus type C (USB-C) connector 30. Fasteners 32 are shown to be used internal to housing 22 to secure housing 12 thereto with face 24 being positioned in an opening 34 so that face 24 is generally flush with face 36 of housing 22.

Housing 22 includes electrical power receptacles 38 and another electrical coupling 40. Opening 34 allows for the ease of upgrading housing 22 with new power/data features as illustrated here with housing 12 being inserted into housing 22. The power supplied to receptacles 38 is by way of power cord 42, in this way the eclectic ability to provide state of the art power and data features to a legacy housing 22 is accomplished without disrupting the legacy power system already in housing 22.

Housing 16 includes an electrical receptacle 44, and a captivating or trapping enclosure 46. Trapping enclosure 46 captivates an end of cable 14 as will be explained hereinafter.

Figure 4:
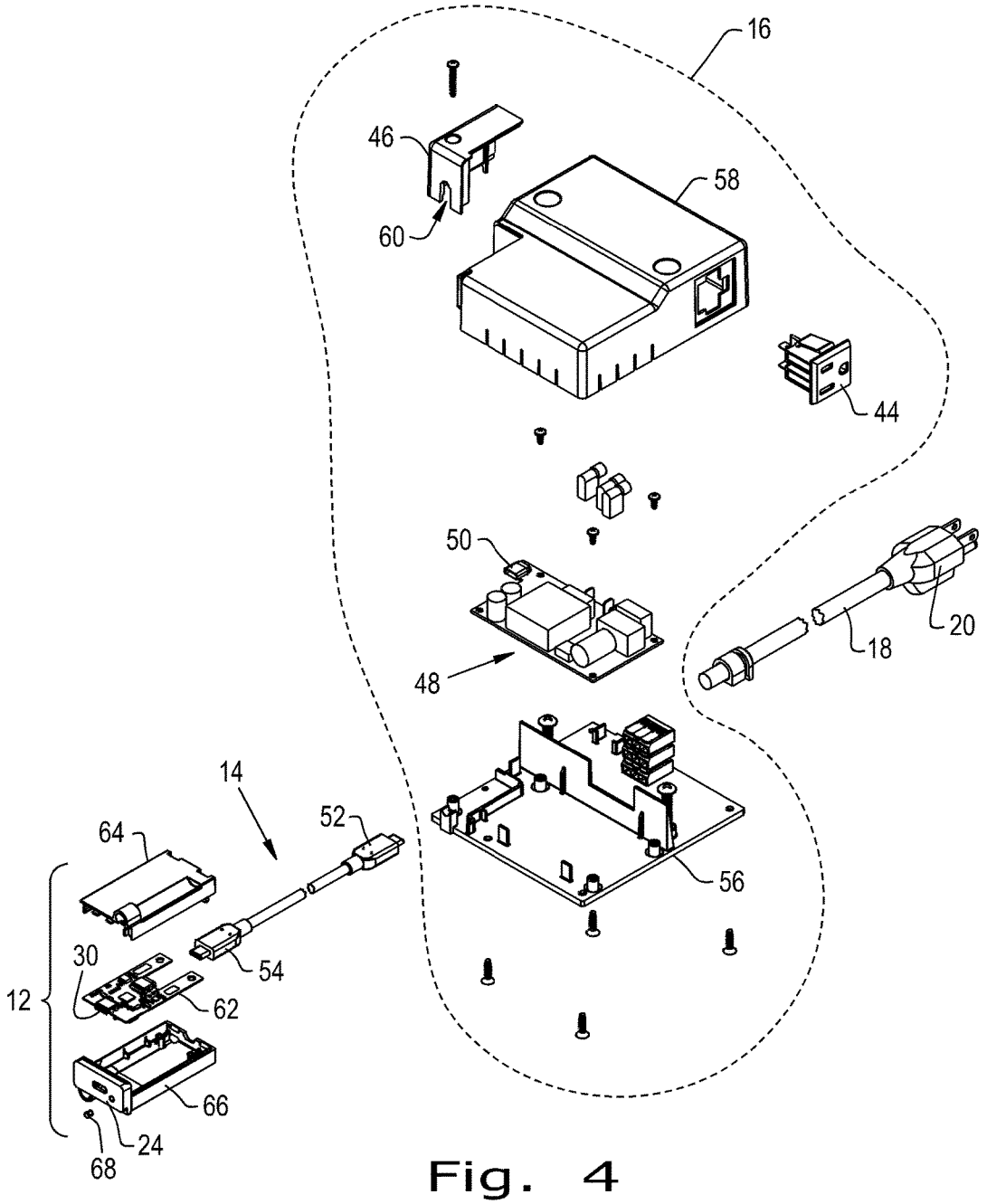
FIG. 4 is an exploded perspective view of the embodiment of FIG. 1.

Now, additionally referring to FIG. 4, housing 16 has a plurality of electrical power output selections that are available from a power circuit 48. A connector 50 is coupled to connector 52 of cable 14 and data and electrical power may be supplied therethrough. Electrical cable 14 has a connector 54 on an end opposite of connector 52, with the ends being interchangeable. Once connector 52 is coupled to connector 50 trapping enclosure 46 is secured to lower hosing 56 and the body of trapping enclosure 46 conforms to the general shape of upper housing 58. An opening slot 60 in enclosure 46 is sized and positioned to keep connector 52 from disengaging from connector 50 and from leaving housing 16. This allows the use of a USB-C type of cable 14 to be used in the present invention.

Housing 12 has electrical receptacle connector 30 that is electrically coupled to a circuit 62 and is enclosed by housing portions 64 and 66. Housing portions 64 and 66 may captivate connector 54 so as to prevent a disengagement of connector 54 from circuit 62. A signal device such as an LED 68 is coupled to circuit 62 to thereby provide information to a user of the active nature of power and the type of power that is available at connector 30. For example, LED 68 may change color depending upon the voltage level and may blink to convey other information, such as current flowing to an attached user device. Circuit 62 sends a signal to circuit 48 instructing it as to which voltage and current capacity to couple to power conductors in cable 14, so that a desired voltage and current capacity is available at connector 30 to be supplied to a user device (not shown) for the purpose of charging the batteries of the user device. It is also contemplated that a data connection can be routed through housing 16 to allow data to also be transmitted by way of cable 14 to the user device. Several voltage and current capacities may be available from circuit 48, such as 20 volts at 5 amps, 5 volts at 3 amps, etc.

Housing 12 is insertable into housing 22 with face 24 being directed toward opening 34. This allows connector 30 to be accessible from outside of housing 22. While assembly 10 can be used as a stand-alone device it is primarily to be used as an update assembly or as a kit to update legacy systems. Connector 30 is, in this example, a Universal Serial Bus type C (USB-C) port that is captivated so that it presents a built-in look on the face 36 of housing 22. The captivation of module 12 to housing 22 takes place inside of housing 22 using fasteners 32.

Housing 22 includes at least one electrical receptacle 38 presented on face 36 that is not powered by way of the electrical cable 14.

The modular electrical receptacle 12 is insertable into receptacle housing 22 and this can be accomplished by inserting the housing 12 into receptacle housing 22; aligning the face 24 of housing 12 to accommodating opening 34 on face 36 of receptacle housing 22; and activating circuit 62 to select one of the plurality of electrical power output selections to be supplied from circuit 48 of housing 16 to electrical connector 30 by way of electrical cable 14.

While electrical receptacles have been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical receptacle assembly, comprising:

a first housing having a plurality of electrical power output selections;

a second housing having an electrical receptacle connector presented on a face thereof; a circuit in the second housing coupled to the receptacle connector; and an electrical cable coupled to the circuit and to the electrical power output selections, the circuit selecting one of the plurality of electrical power output selections to be supplied from the first housing to the connector;

wherein a third housing with an opening therein, the second housing being insertable into the third housing with the face being directed toward the opening;

wherein the connector of the second housing is accessible from outside the third housing;

wherein the connector is a Universal Serial Bus type C (USB-C) port.

2. The electrical receptacle assembly of claim 1, wherein the face of the second housing is generally flush with a face of the third housing.

3. The electrical receptacle assembly of claim 1, wherein the third housing includes at least one electrical receptacle presented on a face of the third housing that is not powered by way of the electrical cable.

4. The electrical receptacle assembly of claim 1, wherein the first housing includes a trapping enclosure, the electrical cable having a connector on an end thereof, the connector of the electrical cable being mated with a connector inside the first housing with the trapping enclosure disengaged and the connector of the electrical cable being captive to the first housing when the trapping enclosure is engaged.

5. The electrical receptacle assembly of claim 1, wherein the second housing is captivated to the third housing.

6. The electrical receptacle assembly of claim 5, wherein the captivation takes place inside of the third housing.

7. A modular electrical receptacle insertable into a receptacle housing, the modular electrical receptacle comprising:

a first housing having a plurality of electrical power output selections;

a second housing having an electrical connector presented on a face thereof;

a circuit in the second housing electrically coupled to the connector; and an electrical cable coupled to the circuit and to the electrical power output selections, the circuit selecting one of the plurality of electrical power output selections to be supplied from the first housing to the electrical connector;

wherein a third housing with an opening therein, the second housing being insertable into the third housing with the face being directed toward the opening;

wherein the connector of the second housing is accessible from outside the third housing;

wherein the connector is a Universal Serial Bus type C (USB-C) port.

8. The modular electrical receptacle of claim 7, wherein the face of the second housing is generally flush with a face of the receptacle housing.

9. The modular electrical receptacle of claim 7, wherein the receptacle housing includes at least one electrical receptacle presented on a face thereof that is not powered by way of the electrical cable.

10. The modular electrical receptacle of claim 7, wherein the first housing includes a trapping enclosure, the electrical cable having a connector on an end thereof, the connector of the electrical cable being mated with a connector inside the first housing with the trapping enclosure disengaged and the connector of the electrical cable being captive to the first housing when the trapping enclosure is engaged.

11. The modular electrical receptacle of claim 7, wherein the second housing is captivatable to the receptacle housing.

12. The modular electrical receptacle of claim 11, wherein the captivation takes place inside of the receptacle housing.

13. A method of installing a modular connector into a receptacle housing, the method comprising the steps of:

providing a modular electrical connector including:

a first housing having a plurality of electrical power output selections; a second housing having an electrical connector presented on a face thereof; a circuit in the second housing electrically coupled to the connector; and an electrical cable coupled to the circuit and to the electrical power output selections;

inserting the second housing into the receptacle housing;

aligning the face of the second housing to an accommodating opening on a face of the receptacle housing; and activating the circuit to select one of the plurality of electrical power output selections to be supplied from the first housing to the electrical connector by way of the electrical cable;

wherein a third housing with an opening therein, the second housing being insertable into the third housing with the face being directed toward the opening;

wherein the connector of the second housing is accessible from outside the third housing;

wherein the connector is a Universal Serial Bus type C (USB-C) port.

* * * * *